US007237993B2

(12) United States Patent
Farley et al.

(10) Patent No.: US 7,237,993 B2
(45) Date of Patent: Jul. 3, 2007

(54) SHIPPING CONTAINER

(76) Inventors: Charles Farley, 3380 Breezewood, Ortonville, MI (US) 48462; Craig Hefner, 7400 Eagle, Davisburg, MI (US) 48350

( * ) Notice: Subject to any disclaimer, the term of this patent is extended or adjusted under 35 U.S.C. 154(b) by 296 days.

(21) Appl. No.: 11/083,764

(22) Filed: Mar. 18, 2005

(65) Prior Publication Data

US 2006/0014618 A1 Jan. 19, 2006

Related U.S. Application Data

(63) Continuation-in-part of application No. 10/894,228, filed on Jul. 19, 2004, now Pat. No. 7,128,509.

(51) Int. Cl.
*B60P 7/06* (2006.01)

(52) U.S. Cl. ..... 410/43

(58) Field of Classification Search ..... 410/2, 410/31, 32, 43, 77, 78, 79, 121
See application file for complete search history.

(56) References Cited

U.S. PATENT DOCUMENTS 4,733,781 A * 3/1988 Gerlach ..... 211/85.8
4,919,277 A * 4/1990 Jeruzal ..... 211/85.8
5,141,114 A * 8/1992 Cate et al. ..... 211/85.8
5,193,692 A * 3/1993 Farley et al. ..... 211/41.14
5,641,076 A * 6/1997 Englund ..... 211/41.14
6,786,687 B1 * 9/2004 Schroeder ..... 410/43
7,014,402 B2 * 3/2006 Kessler ..... 410/155
7,083,369 B2 * 8/2006 Nyeboer ..... 410/43
7,128,509 B2 * 10/2006 Farley et al. ..... 410/43
2004/0131441 A1 * 7/2004 Kessler ..... 410/155

* cited by examiner

*Primary Examiner*—H Gutman
(74) *Attorney, Agent, or Firm*—Gifford, Krass, Sprinkle, Anderson & Citkowski, P.C.

(57) ABSTRACT

A shipping carrier having a frame with at least one elongated cylindrical mounting rod extending transversely across the frame. A plurality of retainers each having molded dunnage are provided wherein each retainer has a flexible tubular cylindrical section with an axially extending through slot formed along one side. The cylindrical section has an inside diameter substantially the same as the outside diameter of the mounting rod and the slot has a width less than the outside diameter of the mounting rod. Dunnage is attached to each of the retainers. The retainers are detachably mounted to the mounting rod by inserting the cylindrical section onto the mounting rod through the slot. The retainer is then pivotal on the mounting rod between a holding position and a release position.

7 Claims, 3 Drawing Sheets

Fig-3
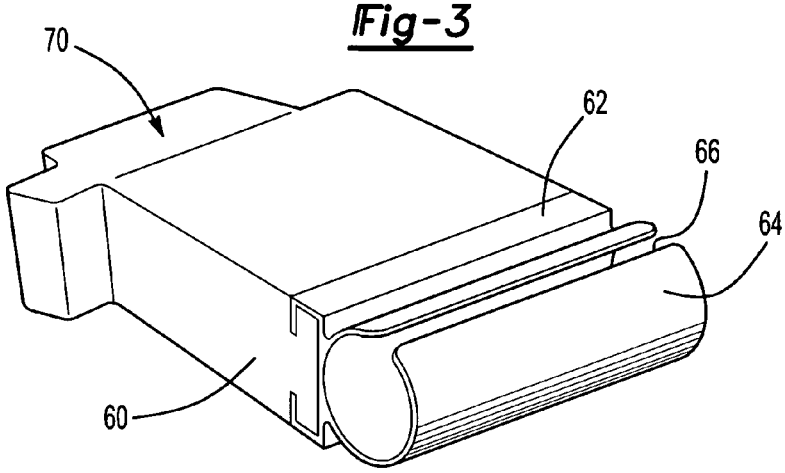
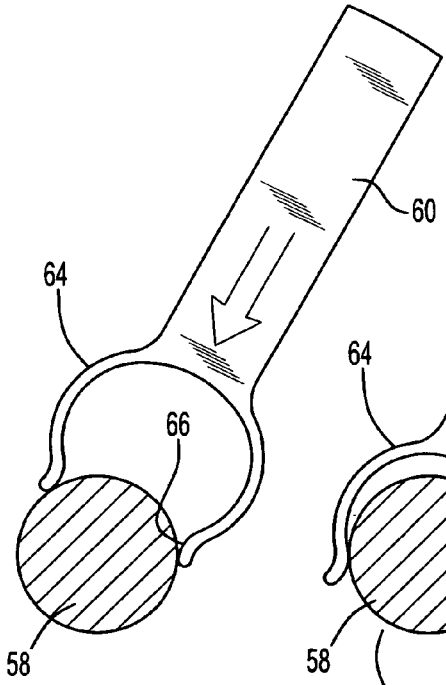
Fig-4A
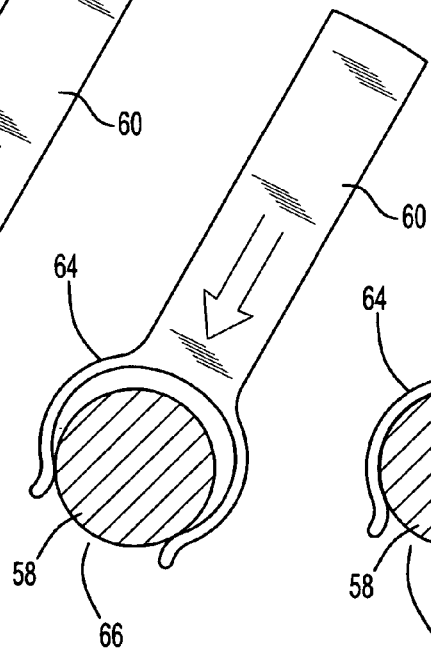
Fig-4B
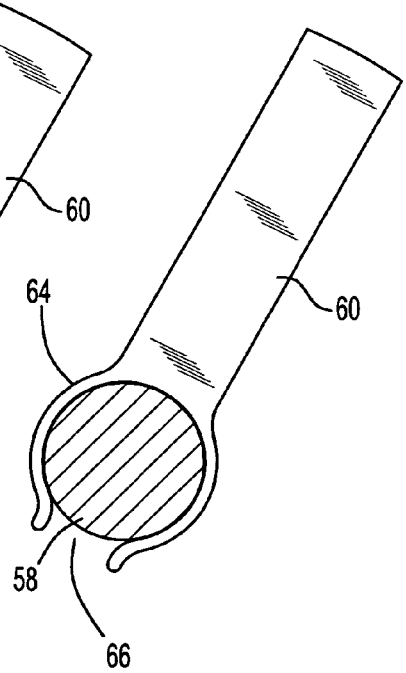
Fig-4C

SHIPPING CONTAINER

CROSS-REFERENCE TO RELATED APPLICATION

The present application is a continuation-in-part of U.S. patent application Ser. No. 10/894,228 filed Jul. 19, 2004 now U.S. Pat. No. 7,128,509.

BACKGROUND OF THE INVENTION

I. Field of the Invention

The present invention relates generally to shipping containers for components.

II. Description of Related Art

Shipping containers are oftentimes used to ship manufactured components from the place of manufacture and to their place of assembly. For example, in the automotive industry, many of the individual components of the automotive vehicles, such as the automotive windshields, are manufactured at one location and then shipped to a different location for assembly on the automotive vehicle.

With reference now to FIGS. 1 and 2, a typical prior art shipping container 20 of the type used in the automotive industry is shown. The shipping container 20 includes a rigid frame 22 which is typically constructed of rectangular metal tubing 24. An elongated cylindrical rod 26 is also mounted to the frame 22.

Still referring to FIGS. 1 and 2, a plurality of dunnage fingers 28 are pivotally mounted to the rod 26 so that the dunnage fingers 28 are pivotal between a release position, illustrated in solid line in FIG. 2, and a holding position, illustrated in phantom line in FIG. 2. In their release position, the dunnage fingers 28 are positioned out of engagement with the components 30 (FIG. 1) transported by the shipping container 20. Conversely, when the dunnage fingers 28 are pivoted to their holding position, the fingers 28 engage the components 30 thus holding the components 30 at predetermined positions to the shipping carrier 20.

As best shown in FIG. 2, each prior art dunnage finger 28 includes a retainer 32 having dunnage 34 molded onto the retainer 32. The dunnage 34 is constructed of any suitable elastomeric material, such as urethane, and the precise shape of the dunnage 34 will vary depending upon on the component 30 transported by the shipping carrier 20.

In order to mount the dunnage fingers 28 to the rod 26, each retainer 32 includes a throughbore 36 having a diameter substantially the same or slightly larger than the outside diameter of the rod 26. With the rod 26 removed from the shipping carrier 20, the dunnage fingers 28 are slid onto the rod such that the rod 26 extends through the retainer bores 36 and so that the retainers 28 are positioned in a side-by-side relationship. Additionally, locking disks are typically provided between adjacent fingers 28 in order to space the fingers 28 apart from each other as desired.

This previously known shipping container, however, suffers from several disadvantages. First, the assembly of the dunnage fingers 28 onto the rod 26 requires that the rod 26 be removed from the frame 22, the fingers 28 inserted onto the rod 26 from one end of the rod 26, and the rod 26 thereafter attached to the frame 22. The entire assembly operation is labor intensive thus adding to the overall cost of the shipping container 20.

A still further disadvantage of this previously known shipping container is that, in the event that one of the dunnage fingers 28 becomes damaged and requires replacement, the entire mounting rod 26 must be removed from the frame 22. Thereafter, all of the dunnage fingers 28 from one end of the rod 26 to the damaged dunnage finger 28 must be removed from the rod 26. A replacement dunnage finger must then be reinserted onto the rod 26, the other removed and undamaged dunnage fingers 28 reinserted onto the mounting rod 26 and the repaired assembly finally reattached to the frame 22. This repair process, however, is disadvantageously time consuming and therefore expensive.

SUMMARY OF THE PRESENT INVENTION

The present invention provides a shipping container particularly suited for the automotive industry which overcomes all of the above-mentioned disadvantages of the previously known shipping containers.

In brief, the shipping carrier of the present invention comprises a frame, typically constructed of metal tubing, and having at least one elongated cylindrical mounting rod extending transversely across the frame. The mounting rod is also typically tubular in cross-sectional shape.

The shipping carrier further comprises a plurality of retainers which are detachably mounted to the mounting rod. Each retainer includes a flexible tubular cylindrical section with an axially extending slot formed along one side of the cylindrical section. The cylindrical section has an inside diameter substantially the same or slightly greater than the outside diameter of the mounting rod while the width of the slot is less than the outside diameter of the mounting rod. Dunnage constructed of an elastomeric material, such as urethane, is then molded onto each retainer.

The retainer cylindrical section is constructed of a resilient material. Consequently, the retainers are detachably mounted to the mounting rod by inserting the cylindrical section onto the mounting rod through the slot. Since the retainer is constructed of a flexible material, the cylindrical section flexes outwardly to enable the cylindrical section to be positioned onto the mounting rod. Once positioned, however, the cylindrical section returns to its original shape and size thus attaching the retainer to the mounting rod.

Each of the retainers is individually removably mounted onto the mounting rod. Thus, assembly of the retainers onto the mounting rod can be rapidly and easily achieved. Furthermore, in the event that one of the retainers and/or its dunnage becomes damaged, the individual retainer may be removed from the mounting rod without removing the other retainers and replaced with a new retainer with its attached dunnage.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which:

FIG. 3 is an elevational view illustrating a portion of the preferred embodiment of the present invention;

FIGS. 4A-4C are fragmentary side views illustrating the operation of the present invention;

DETAILED DESCRIPTION OF A PREFERRED EMBODIMENT OF THE PRESENT INVENTION

Figure 1:
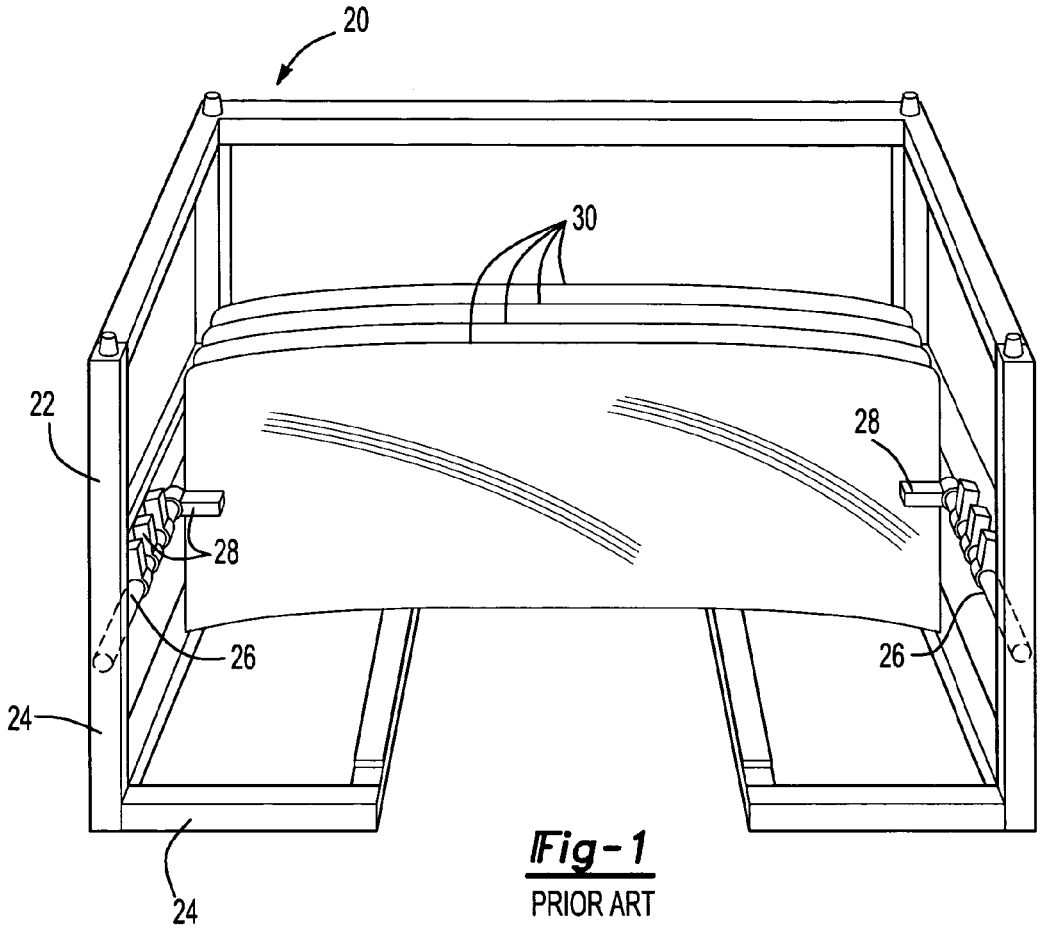
Fig-1 PRIOR ART
FIG. 1 is a prior art elevational view illustrating a prior art shipping carrier.
Figure 2:
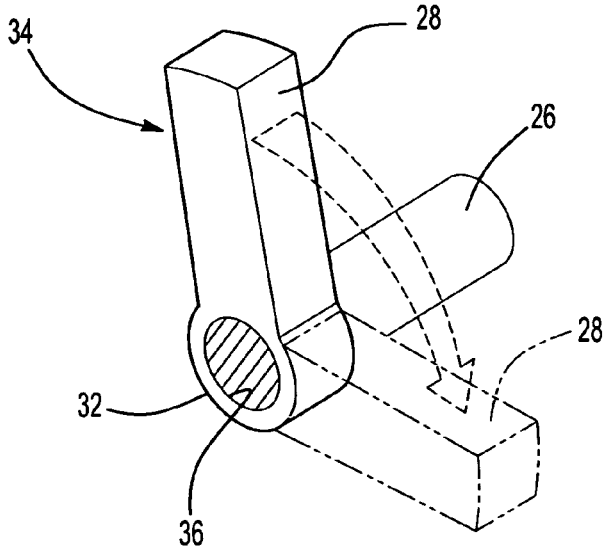
Fig-2 PRIOR ART
FIG. 2 is a fragmentary elevational view illustrating a portion of a prior art shipping carrier.
Figures 5, 6:
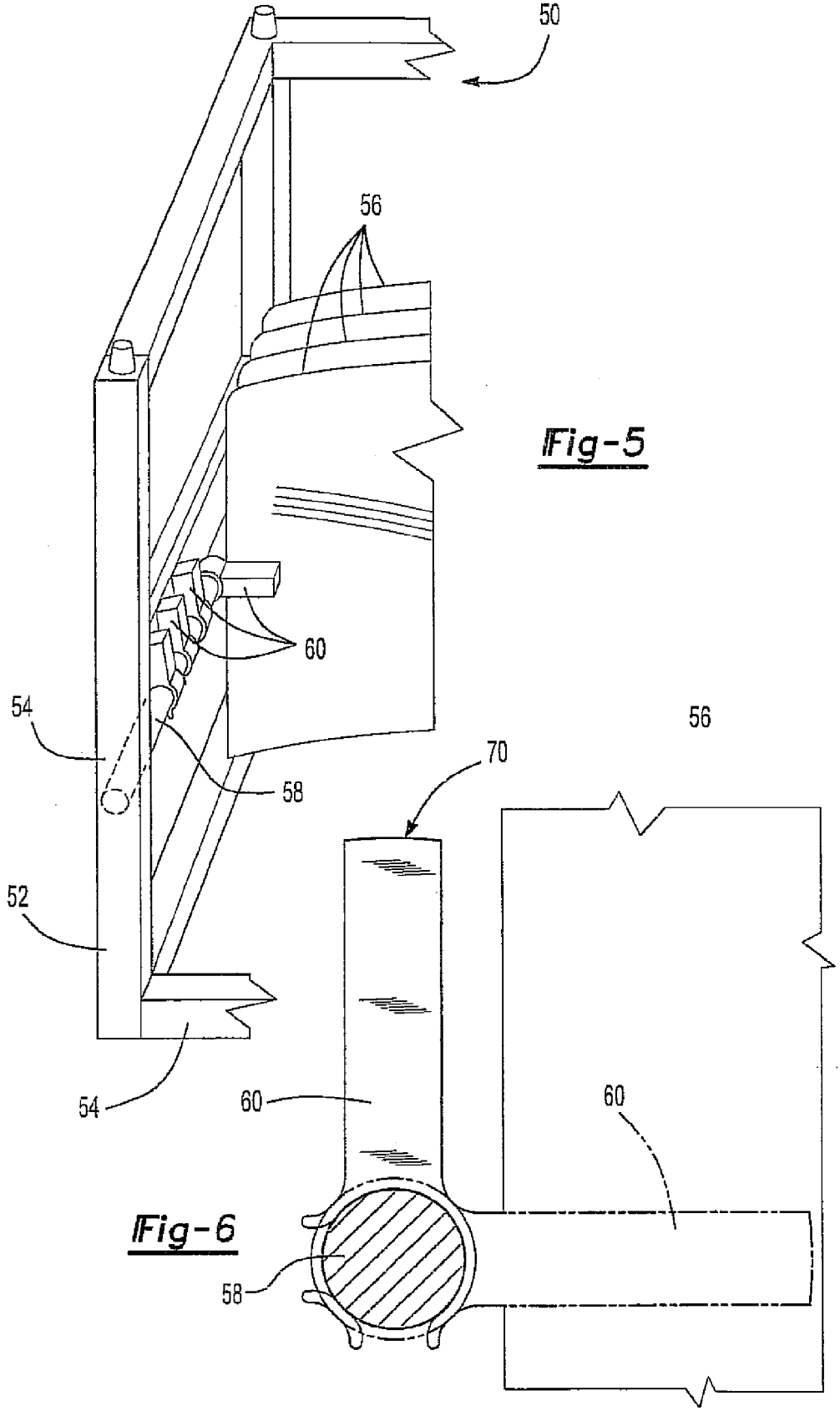
FIG. 5 is an elevational view illustrating a preferred embodiment of the shipping carrier of the present invention.
FIG. 6 is a sectional view illustrating the operation of the present invention.

With reference first to FIG. 5, a preferred embodiment of a shipping carrier 50 of the present invention is shown and comprises a frame 52 which is typically constructed from square metal tubing 54. The carrier 50 illustrated in FIG. 5 is designed to carry a plurality of components 56, such as automotive windshields.

The carrier 50 includes at least one elongated mounting rod 58 which is secured to the frame 52 so that the rod 58 extends transversely across the frame 52. Although the rod 58 may be solid in cross-sectional shape, the rod 58 more typically is tubular in cross-sectional shape.

With reference to FIGS. 5 and 6, a plurality of dunnage fingers 60 are pivotally mounted to the mounting rod 58. As will be subsequently described in greater detail, as the transported components 56 are positioned within the carrier 50, the dunnage fingers 60 are pivoted from a release position illustrated in solid line in FIG. 6, in which the dunnage fingers 60 are disengaged from the component 56, and to a holding position illustrated in phantom line in FIG. 6, in which the dunnage fingers 60 engage the transported components 56 and secure the components 56 against movement relative to the carrier 50.

With reference now to FIG. 3, one dunnage finger 60 is illustrated in greater detail and includes a retainer 62 which is constructed of a flexible material. Preferably, the retainer 62 comprises a plastic extrusion although other materials may alternatively be used.

Still referring to FIG. 3, the retainer 62 includes a flexible tubular cylindrical section 64 having an inside diameter which is substantially the same, i.e. slightly greater than or slightly less than, the outside diameter of the mounting rod 58. An elongated axially extending through slot 66 is also formed through the retainer cylindrical section 64. The width of this slot 66, however, is less than the diameter of the mounting rod 58.

Still referring to FIG. 3, dunnage 70 is attached to the retainer 62. The dunnage 70 is constructed of an elastomeric material, such as urethane, and is molded onto the retainer 62 in any conventional fashion. Furthermore, the actual shape of the dunnage 70 shown in FIG. 3 is by way of example only. The shape of the dunnage 70 will vary depending upon the size and shape of the transported component 56.

With reference now to FIGS. 4A-4C, the dunnage fingers 60 are removably attached to the mounting rod 58 on the shipping carrier frame 52 by snapping the cylindrical section 64 of the retainer 62 onto and over the rod 58. More specifically, as shown in FIG. 4A, the cylindrical section 64 of one dunnage finger 60 is positioned on the mounting rod 58 so that the slot 66 is aligned with the mounting rod 58. The dunnage finger 60 is then inserted onto the mounting rod 58 by pushing the cylindrical section 64 over the mounting rod 58 as shown in FIG. 4B thus flexing the cylindrical section 64 outwardly to permit insertion of the cylindrical section 64 over the mounting rod 58. Finally, after full insertion of the cylindrical section 64 onto the mounting rod 58 as shown in FIG. 4C, the cylindrical section 64 returns to its original shape thus attaching the dunnage finger 60 to the mounting rod 58. In practice, a plurality of dunnage fingers 60 are snapped onto the mounting rod 58 so that the dunnage fingers 60 are positioned in a side-by-side relationship along the length of the mounting rod 58. Optionally, the dunnage fingers 60 are separated from each other on the rod 58 by spacers.

As best shown in FIG. 6, each dunnage finger 60 is pivotal on the mounting rod 58 from a release position, illustrated in solid line, and to a holding position, illustrated in phantom line. In its release position, the dunnage 70 on the dunnage finger 60 is out of engagement with the transported component 56. Conversely, as the dunnage finger 60 is pivoted to its holding position, illustrated in phantom line, the dunnage 70 on the dunnage finger 60 engages the transported component 56 thus securing the transported component 56 to the shipping carrier 50. Any conventional stop mechanism may also be used with the mounting rod 58 to limit the pivotal movement of the dunnage fingers 60 between their holding and release positions.

From the foregoing, it can be seen that the dunnage fingers 60 may be easily and rapidly assembled onto the mounting rod 58 by simply snapping the retainers 62 of the dunnage fingers 60 onto the mounting rod 58 and without removal of the mounting rod 58 from the shipping carrier frame 52. Furthermore, in the event that one or more of the individual dunnage fingers become damaged, the individual fingers may be removed from the mounting rod 58 without removing the adjacent dunnage fingers by simply reversing the process illustrated in FIGS. 4A-4C and thereafter replacing the damaged dunnage finger 60 with a new or undamaged dunnage finger 60.

Having described my invention, many modifications thereto will become apparent to those skilled in the art to which it pertains without deviation from the spirit of the invention as defined by the scope of the appended claims.

We claim:

1. A shipping carrier comprising:

a frame having at least one elongated cylindrical mounting rod extending transversely across said frame, a plurality of dunnage fingers, each dunnage finger having a retainer with a flexible tubular cylindrical section with an axially extending through slot formed along one side, said cylindrical section having an inside diameter substantially the same as an outside diameter of said mounting rod and said slot having a width less than said outside diameter of said mounting rod, dunnage attached to each said retainer, wherein said dunnage fingers are detachably mounted to said mounting rod by inserting said cylindrical section onto said mounting rod through said slot, said dunnage finger being pivotal on said mounting rod between a holding position and a release position.

2. The invention as defined in claim 1 wherein said rod comprises a metal tube.

3. The invention as defined in claim 1 wherein said retainers are mounted adjacent each other on said mounting rod.

4. The invention as defined in claim 1 wherein said retainer is constructed of plastic.

5. The invention as defined in claim 1 wherein said dunnage is molded onto said retainer.

6. The invention as defined in claim 5 wherein said dunnage comprises a urethane.

7. The invention as defined in claim 5 wherein said dunnage comprises an elastomeric material.

* * * * *